US008934811B2

(12) United States Patent
Fumoto

(10) Patent No.: US 8,934,811 B2
(45) Date of Patent: Jan. 13, 2015

(54) DRAWING-IN DEVICE AND IMAGE FORMING APPARATUS

(71) Applicant: Canon Kabushiki Kaisha, Tokyo (JP)

(72) Inventor: Masataka Fumoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 115 days.

(21) Appl. No.: 13/687,964

(22) Filed: Nov. 28, 2012

(65) Prior Publication Data

US 2013/0136491 A1 May 30, 2013

(30) Foreign Application Priority Data

Nov. 30, 2011 (JP) ..... 2011-262133

(51) Int. Cl.
*G03G 15/00* (2006.01)
*G03G 21/16* (2006.01)

(52) U.S. Cl.
CPC ..... *G03G 21/1633* (2013.01); *G03G 15/6502* (2013.01); *G03G 21/1623* (2013.01)
USPC ..... 399/110; 271/147

(58) Field of Classification Search
USPC ..... 399/110; 271/147, 164, 207
See application file for complete search history.

(56) References Cited

U.S. PATENT DOCUMENTS

2006/0180996 A1* 8/2006 Iwase et al. ..... 271/162

FOREIGN PATENT DOCUMENTS

JP 4-85220 A 3/1992
JP 2006-151687 A 6/2006

* cited by examiner

*Primary Examiner* — David Bolduc
*Assistant Examiner* — Barnabas Fekete
(74) *Attorney, Agent, or Firm* — Canon USA Inc IP Division

(57) ABSTRACT

A drawing-in device configured to draw and position a sheet feeding cassette functioning as a unit into a predetermined position of an apparatus main body includes an engage-target tip. The engage-target tip is pressed in the mounting direction of the unit, thus the engage-target tip retreats from a locking position, where a latching pin is locked so as not to disengage, to a retreat position, where the latching pin can engage with the engage-target portion.

10 Claims, 12 Drawing Sheets

Prior Art

Prior Art

Prior Art

DRAWING-IN DEVICE AND IMAGE FORMING APPARATUS

BACKGROUND OF THE INVENTION

1. Field of the Invention

The present disclosure relates to a drawing-in device configured to draw a unit into an apparatus main body, and an image forming apparatus including the drawing-in device.

2. Description of Related Art

In a conventional image forming apparatus such as a printer configured to form an image on a sheet, units which can be mounted on and drawn out from the image forming apparatus main body (hereinafter, referred to as "apparatus main body") are provided. A sheet feeding cassette for storing the sheets, a sheet feeding device (sheet feeding unit) for feeding a sheet from the sheet feeding cassette, and image forming units such as a transfer unit and a fixing unit for forming an image on a sheet can be given as examples of the units.

These units have to be positioned with respect to the apparatus main body with certainty when the units are mounted thereon. Therefore, conventionally, there is provided a drawing-in device which draws the unit into the apparatus main body. Japanese Patent Application Laid-Open No. 4-85220 discusses a drawing-in device which employs a toggle mechanism.

As illustrated in FIG. 10, a drawing-in device 101 which employs the toggle mechanism includes a toggle arm 106 configured to swing about a swing shaft 107. A latching groove 106*a* is formed on a swinging end portion of the toggle arm 106. The latching groove 106*a* latches a latching pin 102 (illustrated in FIG. 11) disposed on the sheet feeding cassette. Further, the drawing-in device 101 includes a toggle spring 108 which is stretched between a shaft 110 disposed on the apparatus main body, and a shaft 109 disposed on the toggle arm 106. In addition, the drawing-in device 101 includes a guide member 111 which latches and guides the latching pin 102.

As illustrated in FIG. 11, when the sheet feeding cassette is inserted to a storage portion of the apparatus main body, the latching pin 102 of the sheet feeding cassette is held by the latching groove 106*a*, thus the sheet feeding cassette is drawn by the elastic force of the toggle spring 108. This will be specifically described hereinafter.

The toggle spring 108 is disposed in such a manner that the biasing direction of the elastic force is inverted from a clockwise direction to a counterclockwise direction at a neutral position thereof. The toggle spring 108 is placed on a standby position near the neutral position, whose phase is slightly shifted from the neutral position, and is biased in the clockwise direction before the sheet feeding cassette is inserted thereto.

When the sheet feeding cassette is inserted, the latching pin 102 is held by the latching groove 106*a* of the toggle arm 106, and when the toggle arm 106 swings and moves beyond the neutral position, the biasing direction of the toggle spring 108 is inverted in the counterclockwise direction. Through this, the sheet feeding cassette is drawn into the apparatus main body.

In such a drawing-in device 101, in a case where an impact and a vibration are given to a drawing-in mechanism thereof while the apparatus main body and a unit such as the sheet feeding cassette have not engaged with each other, the impact and the vibration are transmitted to the toggle arm 106 and the toggle spring 108, which may cause malfunctions of the drawing-in mechanism. In other words, when the impact and the vibration are given to the drawing-in mechanism while the sheet feeding cassette has not engaged with the drawing-in mechanism, there may be a case where the toggle arm 106 is moved to a drawing position by the toggle spring 108, as illustrated in FIG. 11. In such a condition, the toggle arm 106 cannot catch the latching pin 102, thus the sheet feeding cassette cannot be drawn and mounted on the apparatus main body.

Therefore, Japanese Patent Application Laid-Open No. 2006-151687 discusses a technique for making the drawing-in mechanism return to a home position when the malfunction of the drawing-in mechanism caused by the vibration and the impact occurs while the apparatus main body and the sheet feeding cassette have not engaged with each other.

In the technique, as illustrated in FIGS. 12A and 12B, a screwdriver Z is inserted from the front side of the sheet feeding cassette to push the other end portion of the toggle arm 106. The toggle arm 106 is forced to move against the elastic force of the toggle spring 108, and returns to the home position from the drawing position.

However, with the technique discussed in Japanese Patent Application Laid-Open No. 2006-151687, the operation for returning the drawing-in mechanism which malfunctions, to the home position, has to be performed by a user. Therefore, the relevant technique has yet to be improved in terms of usability.

SUMMARY OF THE INVENTION

An advantage of some aspects of the present disclosure is to provide a drawing-in device capable of mounting a unit onto an apparatus main body without causing a user to perform operations for making a drawing-in mechanism return to a home position even in a case where the malfunction of the drawing-in mechanism has occurred.

According to the present disclosure, a drawing-in device configured to draw a unit which can be mounted on and drawn out from an apparatus main body to a predetermined position of the apparatus main body, the drawing-in device includes an engaging portion disposed on one of the apparatus main body and the unit, a drawing-in mechanism disposed on the other of the apparatus main body and the unit, including an engage-target portion that engages with the engaging portion and an elastic member, and configured to draw the unit into the apparatus main body by displacing from a standby position to a drawing position under an elastic force of the elastic member, and an engage-target tip disposed on the engage-target portion and configured to perform locking at a locking position to prevent the engaging portion that engages with the engage-target portion at the drawing position of the drawing-in mechanism from disengaging from the engage-target portion. In the drawing-in device, in a case where the engaging portion does not engage with the engage-target portion at the drawing position of the drawing-in mechanism, the engage-target tip retreats from the locking position to a retreat position being pressed in a mounting direction of the unit by the engaging portion so as to engage the engaging portion with the engage-target portion. The engage-target tip moves to the locking position when the engaging portion engages with the engage-target portion.

According to the present disclosure, when the engage-target tip is pressed in the mounting direction of the unit, the engage-target tip retreats to the retreat position where the engaging portion can engage with the engage-target portion, from the locking position where the engage-target tip performs locking to prevent the engaging portion from disengaging. Accordingly, even in a case where the drawing-in mechanism malfunctions, the unit can be mounted onto the apparatus main body without causing the user to perform the operations for making the drawing-in mechanism return to the home position.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles as disclosed herein.

DESCRIPTION OF THE EMBODIMENTS

Various exemplary embodiments, features, and aspects of the invention will be described in detail below with reference to the drawings.

Figure 4:
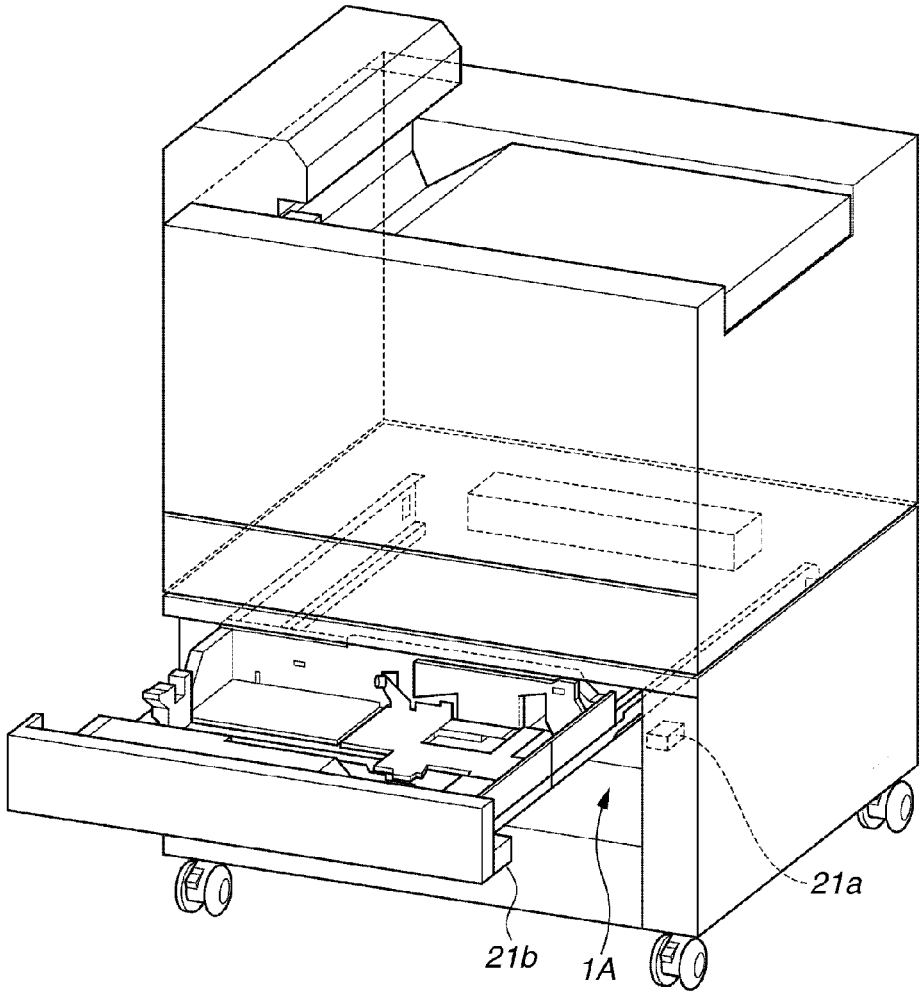
FIG. 4 is a diagram illustrating a unit positioning mechanism.
Figure 5A:
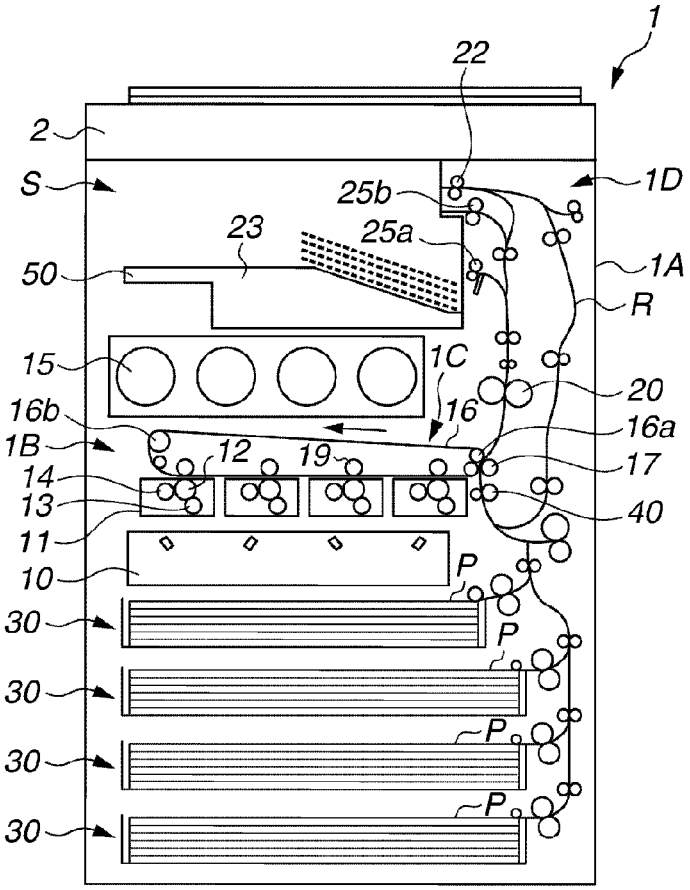
FIGS. 5A and 5B are diagrams illustrating an image forming apparatus which employs the drawing-in device as disclosed herein.
Figure 5B:
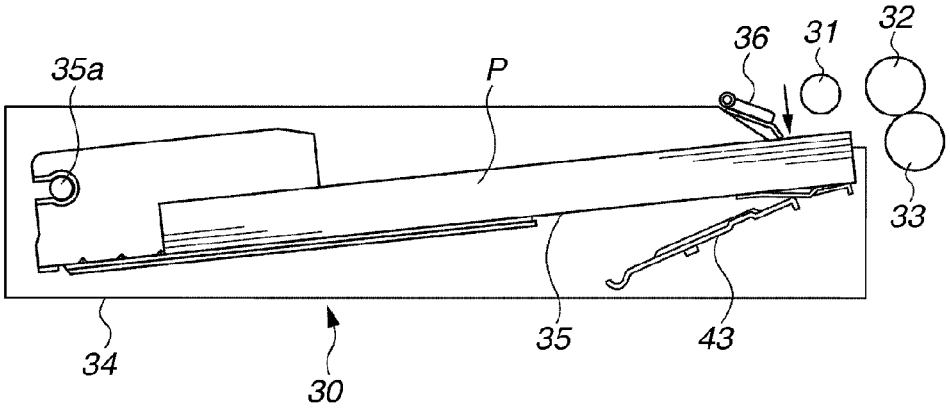

FIG. 5A is a diagram illustrating a general configuration of an image forming apparatus which employs a drawing-in device according to the present disclosure. FIG. 5B is a cross-sectional diagram of a sheet feeding cassette 9 disposed on the image forming apparatus. Further, FIG. 4 is a perspective view of the image forming apparatus.

In FIG. 5A, a full-color laser beam printer (hereinafter, referred to as "printer") 1 includes an image forming apparatus main body (printer main body) 1A, an image forming unit 1B which forms an image on a sheet, and a fixing unit 20. An image reading device 2 is an upper device disposed on the upper side of the printer main body 1A in an approximately horizontal manner. A sheet discharge space S for discharging the sheet is formed between the image reading device 2 and the printer main body 1A. Further, the printer 1 also includes toner cartridges 15.

The image forming unit 1B includes process cartridges 11. Each of the process cartridges 11 includes a photosensitive drum 12, a charger 13 serving as a charging unit, and a developing device 14 serving as a developing unit. Further an intermediate transfer unit 1C is disposed on the upper side of the process cartridges 11.

When a first transfer roller 19 applies a positive polarity transfer bias on an intermediate transfer belt 16, a toner image having a negative polarity formed on the photosensitive drum 12 is transferred to the intermediate transfer belt 16. A second transfer roller 17 is arranged in a position opposite to a drive roller 16*a* of the intermediate transfer unit 1C. The second transfer roller 17 configures a second transfer unit which transfers a color image formed on the intermediate transfer belt 16 to a sheet P. Further, the fixing unit 20 is disposed on the upper side of the second transfer roller 17.

Next, an image forming operation of the printer 1 configured as the above will be described. First, the image reading device 2 reads image information of a document, and image processing is performed on the image information. Thereafter, the image information is transformed to an electrical signal and transmitted to a laser scanner 10 of the image forming unit 1B. The image information may be input to the image forming unit 1B from an external device such as a computer. In the image forming unit 1B, the laser scanner 10 emits a laser beam and scans a surface of the photosensitive drum 12 of each process cartridge 11. Through this, the surface of each photosensitive drum 12 which is uniformly charged with predetermined polarity and potential by the charger 13 is exposed sequentially, and an electrostatic latent image is formed on the photosensitive drum 12 of each process cartridge 11 in a sequential manner.

After that, each of the electrostatic latent images is developed and visualized with toner of each color. Then, the first transfer bias applied on the first transfer roller 19 causes the toner image in each color formed on each photosensitive drum 12 to be sequentially overlapped and transferred onto the intermediate transfer belt 16. Through this, the toner image is formed on the intermediate transfer belt 16.

In parallel with the toner image forming operation, the sheet P is fed out from a sheet feeding device 30. As illustrated in FIG. 5B, the sheet feeding device 30 is configured in such a manner that an uppermost sheet stacked on a sheet stacking plate 35 of the sheet P feeding cassette 9 is picked up by a sheet feeding roller 31 and conveyed to a separation-conveyance roller pair configured of a conveyance roller 32 and a separation roller 33. The sheet stacking plate 35 is controlled so that the sheet surface thereof is lifted up to a proper sheet feeding height when the sheets P on the sheet stacking plate 35 are fed and decreased in height. When all the sheets P are fed and there is no sheet available, absence of the sheet P is detected by a sheet presence detection sensor 36. With this, the sheet feeding operation is suspended, and a notification prompting replenishment of the sheet P is made on an operation panel. In a case where no available sheets P are stored in the sheet feeding cassette 9, a user pulls out the sheet feeding cassette 9, and supplies and stores the sheets into the sheet feeding cassette 9 again.

After the feeding, the sheet P is conveyed to the second transfer unit through a registration roller pair 40. In the second transfer unit, the second transfer bias that is applied on the second transfer roller 17 causes the toner image to be transferred onto the sheet P.

Next, the sheet P on which the toner image is transferred in this manner is conveyed to the fixing unit 20. In the fixing unit 20, heat and pressure are applied on the sheet P, so that the toner image is fixed thereon as a color image. Thereafter, the sheet P on which the image is fixed is discharged to the sheet discharge space S by a first discharge roller pair 25*a* disposed on the downstream side of the fixing unit 20, and stacked on a stacking unit 23 projected from a bottom surface of the sheet discharge space S.

Figure 1:
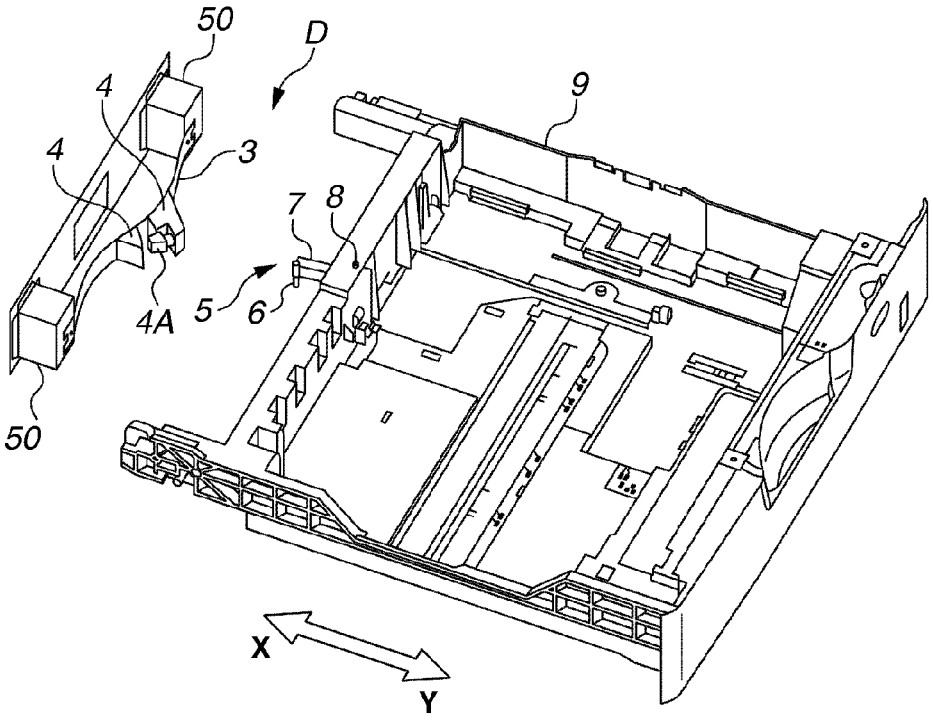
FIG. 1 is a diagram illustrating a drawing-in device according to a first exemplary embodiment.

Next, a first exemplary embodiment will be described. In FIG. 1, the sheet feeding cassette 9 is a unit that can be mounted on and drawn out from the printer main body 1A. A drawing-in mechanism D draws and positions the sheet feeding cassette 9 in a predetermined position of the printer main body 1A.

First, a drawing-in device which employs a snap buckling mechanism of an elastic member will be described with reference to FIG. 1. The drawing-in mechanism D includes a plate spring 3 serving as an elastic member which snap buckles, and an engage-target portion 4 disposed on the plate spring 3. Further, the engage-target portion 4 includes an engage-target tip 4A. An engaging portion 5 includes a latching pin 6 which engages with the engage-target portion 4, an arm 7 which supports the latching pin 6 capable of swinging, and a rotation shaft 8 which supports the arm 7 in a rotatable manner. In the present exemplary embodiment, the engaging portion 5 is disposed on the sheet feeding cassette 9 which functions as a unit, whereas the drawing-in mechanism D is disposed on the printer main body 1A.

As illustrated in FIG. 1, when the sheet feeding cassette 9 is drawn out from the printer main body 1A, both ends of the plate spring 3 are supported by both-end supporting portions 50 in a warped state. The both-end supporting portions 50 are disposed on the printer main body 1A, and the engage-target portions 4 are arranged along the plate spring 3.

The plate spring 3 elastically deforms when the forces are applied in a mounting direction X and a drawing direction Y of the sheet feeding cassette 9 to and from the printer main body 1A respectively. Because the plate spring 3 is supported in a warped state, when the forces applied in the mounting direction X and the drawing direction Y become greater than a certain level, the plate spring 3 deforms in a snap buckling manner in the direction of the applied force.

In the present exemplary embodiment, "snap buckling" refers to a phenomenon in which, when the force is applied to a warped elastic member from the outside and the applied force becomes greater than a certain level, the warped elastic member deforms rapidly and warps in the direction to which the force is applied (i.e., a direction opposite to the elastic member warping) even if the force is not applied further. In addition, the deformation caused by snap buckling is an elastic deformation. Therefore, the elastic member which deforms in one direction in the snap buckling may deform in the other direction in the snap buckling manner when the force in the other direction is applied thereto.

Stainless steel for spring, copper-beryllium alloy for spring, phosphor bronze for spring, or nickel silver for spring can be used as a material for the elastic member according to the present exemplary embodiment which snap buckles. A plate-shape metallic whose thickness is relatively thin can easily snap buckle.

Next, operations of mounting and drawing the sheet feeding cassette 9 to and from the printer main body 1A, which are performed by the drawing-in mechanism D, will be described with reference to FIGS. 2A through 2D. FIGS. 2A through 2D are diagrams illustrating a general operation for mounting the sheet feeding cassette 9 on a predetermined position (i.e., mounting completion position) of the printer main body 1A.

Figure 2A:
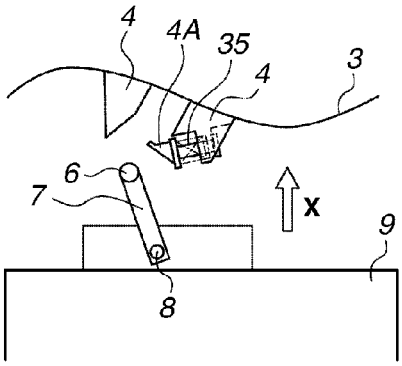
FIGS. 2A through 2D are diagrams illustrating an operation for drawing a unit according to the first exemplary embodiment.

First, an operation for mounting the sheet feeding cassette 9 on the printer main body 1A will be described. FIG. 2A illustrates a state where the sheet feeding cassette 9 is drawn out from the printer main body 1A. As illustrated in FIG. 2A, the drawing-in mechanism D is a standby position when the sheet feeding cassette 9 is drawn out from the printer main body 1A.

Figure 2B:
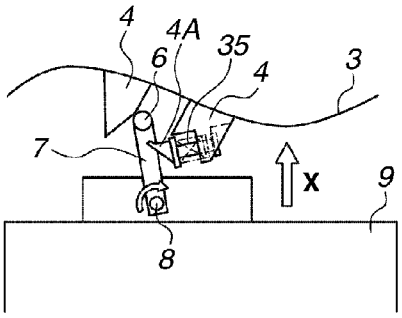
Figure 2C:
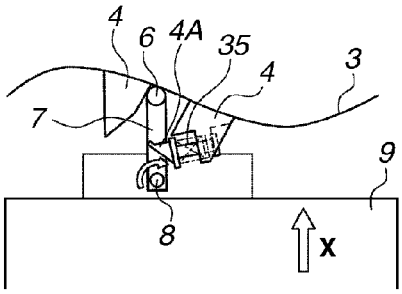

As illustrated in FIG. 2B, when the sheet feeding cassette 9 is inserted in the mounting direction X, the latching pin 6 abuts on the engage-target portion 4. When the sheet feeding cassette 9 is further inserted in the mounting direction X, the latching pin 6 is guided by the engage-target portion 4 to cause the arm 7 to swing. Then, as illustrated in FIG. 2C, the engaging pin 6 abuts on the plate spring 3.

Figure 2D:
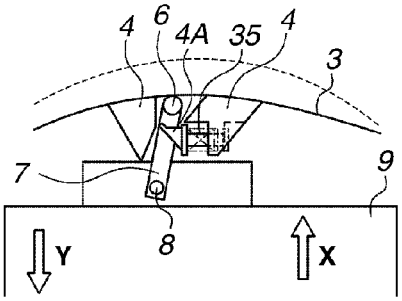

When the sheet feeding cassette 9 is inserted further in the mounting direction X, the latching pin 6 pushes the plate spring 3 toward the rear side plate of the printer main body 1A, thus the plate spring 3 elastically warps and deforms in the mounting direction X. When the amount of force applied on the plate spring 3 becomes greater than a certain level, the plate spring 3 is deformed in the mounting direction X by the snap buckling, as illustrated in FIG. 2D. FIG. 2D illustrates a state where the drawing-in mechanism D causes the sheet feeding cassette 9 to be drawn into and mounted on the printer main body 1A. As illustrated in FIG. 2D, the drawing-in mechanism D is placed at a drawing position when the sheet feeding cassette 9 is mounted on the printer main body 1A.

When the plate spring 3 is deformed by the snap buckling, the plate spring 3 is displaced in the drawing position to generate a drawing force in the mounting direction X due to the elastic force. When the plate spring 3 is deformed into a state illustrated in FIG. 2D by the snap buckling, the engage-target portion 4 and the latching pin 6 keep engaging with each other. As a result, the sheet feeding cassette 9 is drawn into the printer main body 1A via the engaging portion 5 and the engage-target portion 4. In addition, as illustrated in FIG. 2D, the drawing-in mechanism D is placed at the drawing position when the sheet feeding cassette 9 is mounted on the printer main body 1A. In a case where the drawing-in mechanism D is placed at the drawing position, the engage-target tip 4A performs locking at the locking position to prevent the latching pin 6 from disengaging.

Generally, an image forming apparatus is provided with a positioning mechanism which positions the unit in the mounting direction of the apparatus main body. As illustrated in FIG. 4, a positioning mechanism according to the present exemplary embodiment is configured of an abutting member 21*b* disposed on the sheet feeding cassette 9, and a reference member 21*a* disposed on the printer main body 1A. When the sheet feeding cassette 9 is mounted on the printer main body 1A and the abutting member 21*b* abuts on the reference member 21*a*, positioning of the sheet feeding cassette 9 in the mounting direction X is carried out.

The deformation of the plate spring 3 caused by the snap buckling is suspended halfway when the sheet feeding cassette 9 is positioned by the positioning mechanism. In a case where the positioning of the sheet feeding cassette 9 is not carried out by the positioning mechanism, the plate spring 3 is deformed to a state indicated by a broken line in FIG. 2D by the snap buckling. Therefore, in a state in which the sheet feeding cassette 9 is mounted on the printer main body 1A, the sheet feeding cassette 9 is located at a position where the positioning mechanism suspends halfway the deformation of the plate spring 3 caused by the snap buckling. Accordingly, the force in the mounting direction X acts on the sheet feeding cassette 9, and the plate spring 3 causes the sheet feeding cassette 9 to be biased in the drawing direction. Through this, the sheet feeding cassette 9 is positioned on the mounting completion position of the printer main body 1A with certainty.

In other words, when the user inserts the sheet feeding cassette 9 in the mounting direction X into the printer main body 1A and a force greater than a certain level is applied on the plate spring 3, the plate spring 3 snap buckles, and the sheet feeding cassette 9 is drawn into the mounting completion position as illustrated in FIG. 2D. Accordingly, the sheet feeding cassette 9 can be positioned in the printer main body 1A with certainty. On the other hand, when the force applied on the plate spring 3 by inserting the sheet feeding cassette 9 is less than a certain level, the elastically-deformed plate spring 3 returns to a state illustrated in FIG. 2C. Therefore, the sheet feeding cassette 9 may not be mistakenly recognized as being mounted.

Next, an operation for drawing out the sheet feeding cassette 9 mounted on the printer main body 1A will be described with reference to FIGS. 2A through 2D. When the sheet feeding cassette 9 in the mounting completion position in FIG. 2D is drawn out in the drawing direction Y, the latching pin 6 that engages with the engage-target portion 4 elastically deforms the plate spring 3 in the drawing direction Y.

When the sheet feeding cassette 9 is drawn out in the drawing direction Y and the amount of force applied on the plate spring 3 becomes greater than a certain level, the plate spring 3 snap buckles in the drawing direction Y (i.e., in the direction opposite to the inserting direction). As a result, the plate spring 3 comes into a state as illustrated in FIG. 2C.

When the plate spring 3 snap buckles, the plate spring 3 generates a force in the drawing direction Y. In a case where the state of the plate spring 3 changes from the state in FIG. 2D to that in FIG. 2C by the snap buckling, the engage-target portion 4 and the latching pin 6 keep engaging with each other. Therefore, the sheet feeding cassette 9 is drawn out through the engage-target portion 4 and the engaging portion 5.

As described above, the drawing-in mechanism D which employs snap buckling of the elastic member can reliably position the unit on the printer main body 1A with a simplified configuration.

Figure 3:
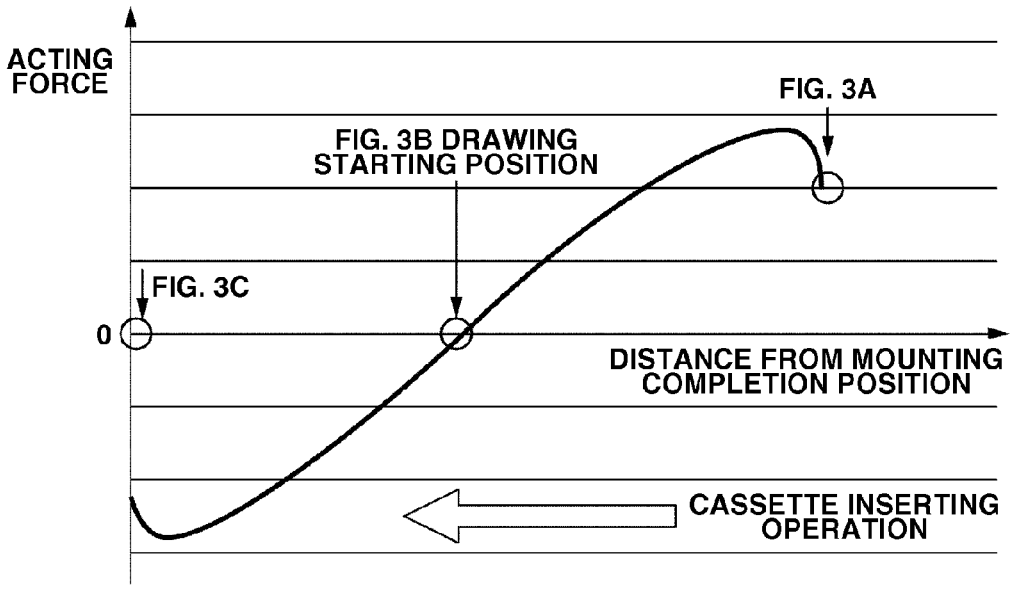
FIG. 3 is a graph illustrating an acting force of a unit mounting operation.

FIG. 3 is a graph illustrating an acting force of the plate spring 3 on the mounting and drawing operations of the sheet feeding cassette 9. The vertical axis represents a force of the plate spring 3 acting on the sheet feeding cassette 9, whereas the horizontal axis represents a distance between the sheet feeding cassette 9 and the mounting completion position in the printer main body 1A. When the acting force is a positive value, the plate spring 3 has a force for pushing the sheet feeding cassette 9 in the drawing direction Y. When the acting force is a negative value, the plate spring 3 has a force for drawing the sheet feeding cassette 9 into the mounting direction X.

More specifically, in a case where the user inserts the sheet feeding cassette 9, the force for pushing the sheet feeding cassette 9 in the mounting direction X is required because the acting force is a positive value when the distance between the sheet feeding cassette 9 and the mounting completion position ranges from FIG. 3A to FIG. 3B. However, when the distance between the sheet feeding cassette 9 and the mounting completion position ranges from FIG. 3B to FIG. 3C, the sheet feeding cassette 9 is drawn in the mounting direction X even if the user does not manually push the sheet feeding cassette 9 because the acting force is a negative value.

Next, an operation for mounting the sheet feeding cassette 9 when the drawing-in mechanism D malfunctions will be described. In the above-described drawing-in device which employs elastic force of the elastic member, the drawing-in mechanism D may malfunction in a case where the impact and the vibration are given to the drawing-in mechanism D while the printer main body 1A and the sheet feeding cassette 9 is not engaged with each other.

Figure 6A:
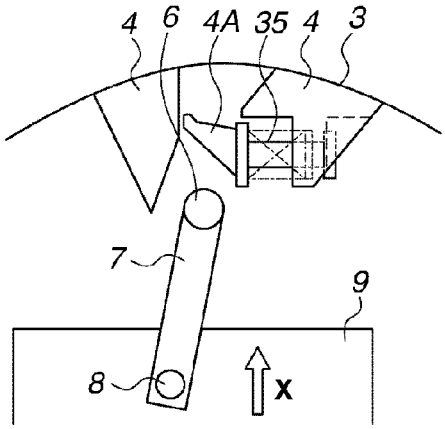
FIGS. 6A through 6C are diagrams illustrating the drawing-in device according to the first exemplary embodiment.

FIG. 6A illustrates a state in which the drawing-in mechanism D is displaced from the standby position to the drawing position caused by the malfunction thereof. The "drawing-in mechanism D in the standby position" represents a state where the plate spring 3 is projected forward, whereas the "drawing-in mechanism D in the drawing position" represents a state where the plate spring 3 is projected backward. The engage-target tip 4A of the drawing-in mechanism D in the drawing position is biased in the left direction (locking position) in FIG. 6A by a compression spring 35 which serves as a spring member.

Figure 6B:
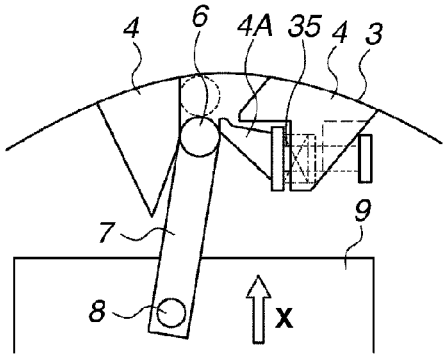

When the user inserts the sheet feeding cassette 9 in the mounting direction X, the latching pin 6 of the engaging portion 5 presses the engage-target tip 4A. When the latching pin 6 presses the engage-target tip 4A in the mounting direction X, the compression spring 35 is compressed. Accordingly, as illustrated in FIG. 6B, the engage-target tip 4A moves against the spring force and retreats in the right direction (retreat position) in FIG. 6B. The position of the engage-target tip 4A in FIG. 6A represents the locking position, whereas the position of the engage-target tip 4A in FIG. 6B represents the retreat position.

Figure 6C:
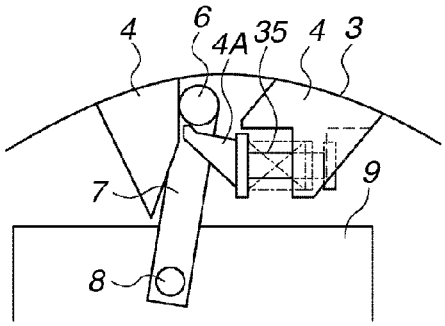

The latching pin 6 can engage with the engage-target portion 4 when the engage-target tip 4A retreats to the retreat position. As illustrated in FIG. 6C, when the latching pin 6 engages with the engage-target portion 4, the engage-target tip 4A moves from the retreat position to the locking position under the biasing force of the compression spring 35. In the locking position, the engage-target tip 4A prevents the latching pin 6 from disengaging from the engage-target portion 4.

As described above, according to the present exemplary embodiment, the engage-target portion 4 includes the engage-target tip 4A. Accordingly, the sheet feeding cassette 9 which is a unit can be mounted on the printer main body 1A in a proper state even in a case where the drawing-in mechanism D malfunctions. Thereafter, the drawing-in mechanism D can operate properly.

Next, a second exemplary embodiment according to the present disclosure will be described with reference to FIGS. 7A through 7C. The present exemplary embodiment is different from the first exemplary embodiment only in that the engage-target tip 4A is disposed to rotate about a rotating shaft when the engage-target tip 4A is pressed in the mounting direction X, and thus the engage-target tip 4A can rotate and retreat from the locking position to the retreat position. Therefore, the configurations common with the first exemplary embodiment will not be described.

Figure 7A:
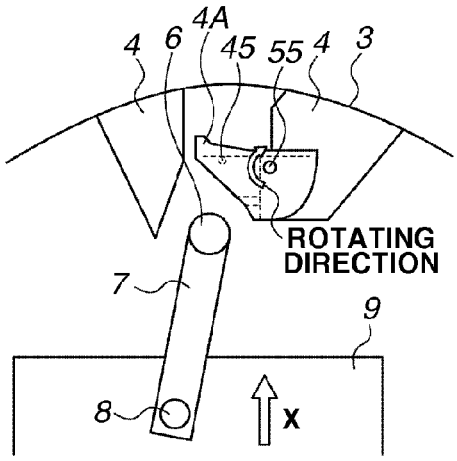
FIGS. 7A through 7C are diagrams illustrating a drawing-in device according to a second exemplary embodiment.
Figure 7B:
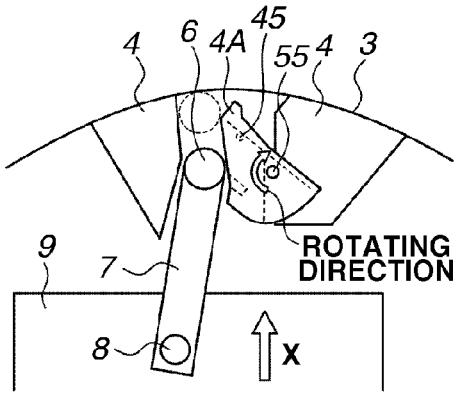

As illustrated in FIG. 7A, a drawing-in device according to the present exemplary embodiment includes a biasing spring 45 and a rotating shaft 55. The biasing spring 45 serves as a spring member which biases the engage-target tip 4A to the locking position. The engage-target tip 4A is biased to the locking position by the biasing spring 45 that is disposed between the engage-target tip 4A and the engage-target portion 4. As illustrated in FIG. 7B, when the user inserts the sheet feeding cassette 9 in the mounting direction X, the latching pin 6 presses the engage-target tip 4A in the mounting direction X of the unit. The engage-target tip 4A rotates about the rotating shaft 55 and retreats to the retreat position from the locking position.

Figure 7C:
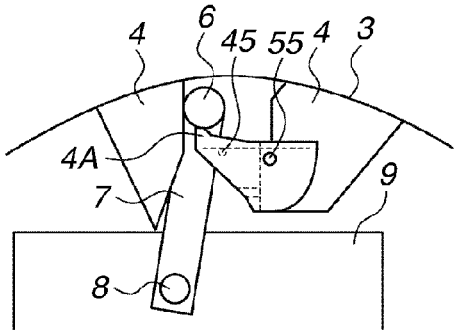

As illustrated in FIG. 7C, the latching pin 6 can engage with the engage-target portion 4 when the engage-target tip 4A retreats to the retreat position. The engage-target tip 4A moves to the locking position caused by the biasing force of the biasing spring 45 when the latching pin 6 engages with the engage-target portion 4. The engage-target tip 4A performs locking at the locking position and prevents the latching pin 6 from disengaging from the engage-target portion 4. Accordingly, the same effects as in the first exemplary embodiment can be achieved in the present exemplary embodiment.

Next, a third exemplary embodiment will be described with reference to FIGS. 8A and 8B. The present exemplary embodiment is different from the first exemplary embodiment only in that a groove 86 is provided on the engage-target portion 4, while the rest of the configurations are the same as in the first exemplary embodiment. Therefore, the configurations common with the first exemplary embodiment will not be described.

As described above, a drawing-in device according to the exemplary embodiment of the present disclosure includes the engage-target tip 4A which retreats when pressed in the mounting direction X of the unit. In the first exemplary embodiment and the second exemplary embodiment, the latching pin 6 abuts on the engage-target tip 4A when the sheet feeding cassette 9 mounted on the printer main body 1A is drawn out. In this case, the latching pin 6 places a heavy load on the engage-target tip 4A if the weight of paper stacked on the sheet feeding cassette 9 is heavy, or the speed for drawing out the sheet feeding cassette 9 is high. Because the engage-target tip 4A is disposed to retreat when pressed in the mounting direction X of the unit, there is a risk that the engage-target tip 4A may be deformed or degraded if a heavy load is placed in the drawing direction of the unit. In the present exemplary embodiment, deformation and degradation of the engage-target tip 4A caused by the load placed on the engage-target tip 4A by the latching pin 6 at the time of drawing the sheet feeding cassette 9, are prevented from occurring.

Figure 8A:
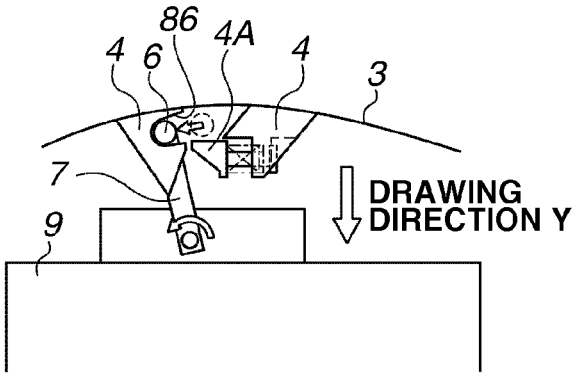
FIGS. 8A and 8B are diagrams illustrating a drawing-in device according to a third exemplary embodiment.
Figure 8B:
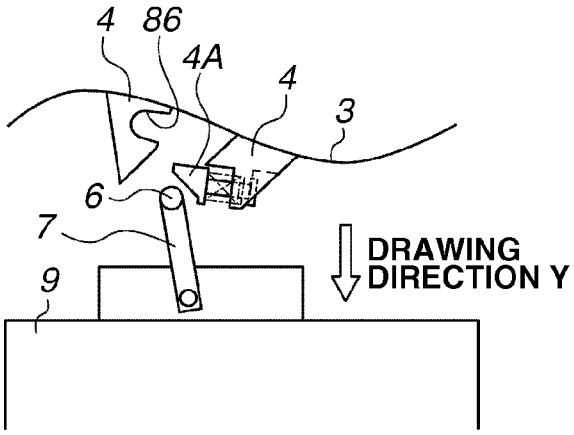

As illustrated in FIG. 8A, in the drawing-in device according to the present exemplary embodiment, the groove 86 is provided on the engage-target portion 4, and the latching pin 6 can be fit therein. When the sheet feeding cassette 9 is drawn out, the latching pin 6 is fit into the groove 86. Therefore, the latching pin 6 does not abut on the engage-target tip 4A. Accordingly, the present exemplary embodiment can achieve not only the same effect achieved in the first exemplary embodiment, but also the effect in which the sheet feeding cassette 9 can be drawn out up until a state illustrated in FIG. 8B without placing a load on the engage-target tip 4A.

In the above-described first through third exemplary embodiments, the drawing-in mechanism D which employs the snap buckling mechanism of the elastic member is described. However, the drawing-in mechanism D according to the exemplary embodiment of the present disclosure is not limited to the one employing the snap buckling mechanism, and various types of drawing-in mechanism can be employed.

Figure 9:
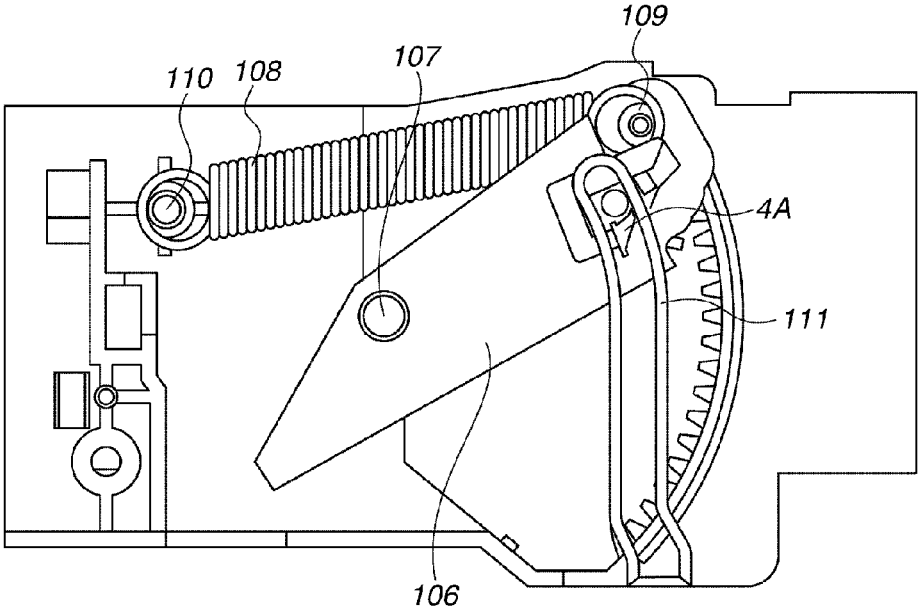
FIG. 9 is a diagram illustrating a drawing-in device according to a fourth exemplary embodiment.
Figure 10:
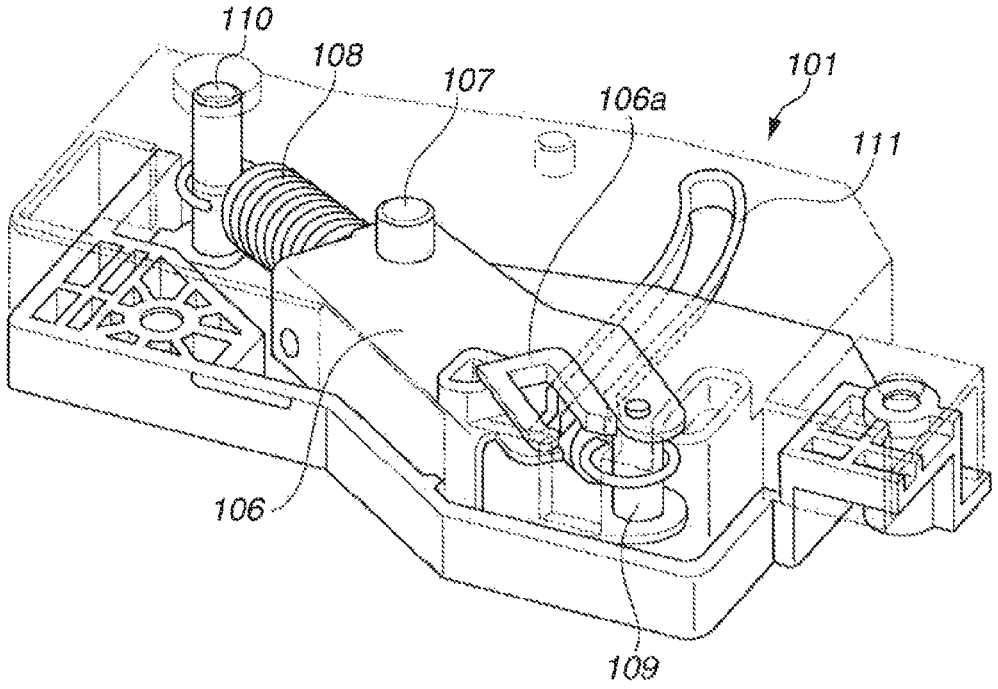
FIG. 10 is a diagram illustrating a drawing-in device according to a technique discussed in Japanese Patent Laid-Open No. 4-85220.
Figure 11:
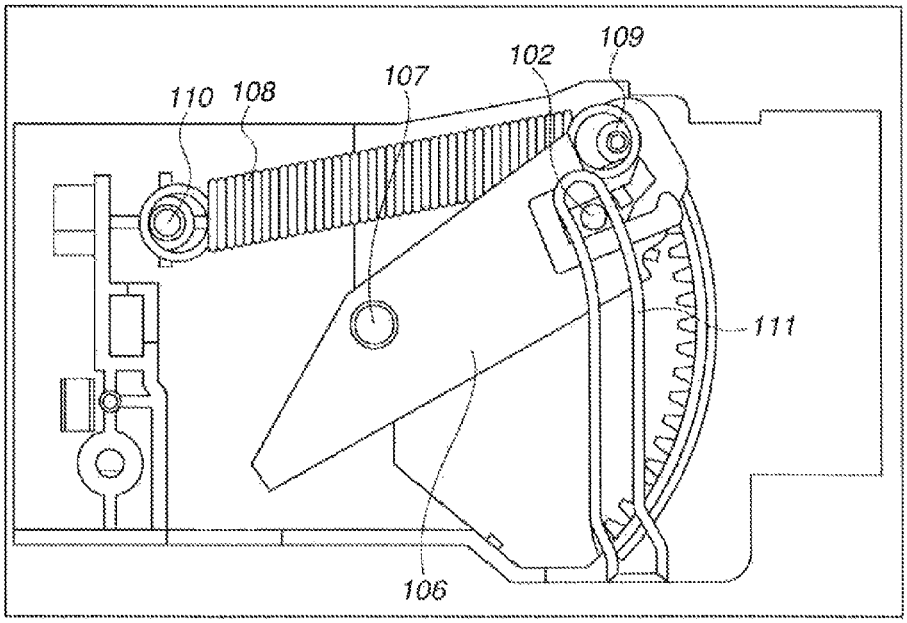
FIG. 11 is a diagram illustrating a drawing-in device according to a technique discussed in Japanese Patent Laid-Open No. 2006-151687.
Figure 12A:
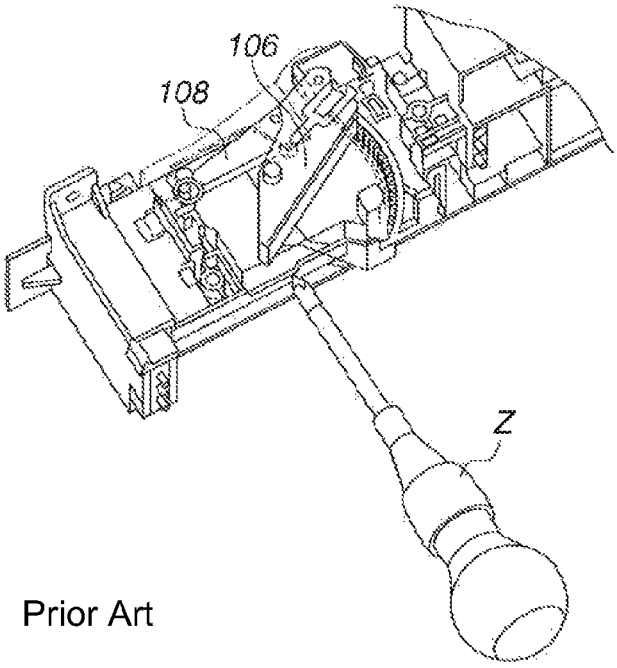
FIGS. 12A and 12B are diagrams illustrating the drawing-in device according to the technique discussed in Japanese Patent Laid-Open No. 2006-151687.
Figure 12B:
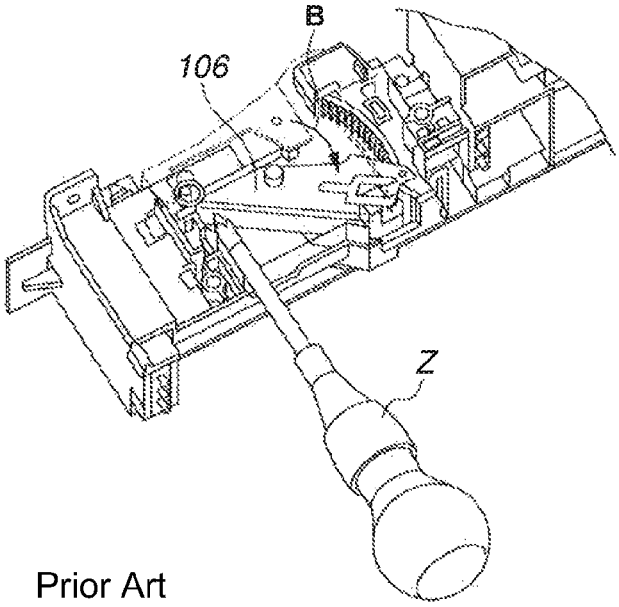
Prior Art FIG.12B

For example, as illustrated in FIG. 9, the toggle mechanism can be employed as the drawing-in mechanism D according to a fourth exemplary embodiment. In a case where the toggle mechanism is employed as the drawing-in mechanism D, the engage-target tip 4A is disposed on the latching grave 106*a* of the toggle arm 106 serving as the engage-target portion 4. Also in the present exemplary embodiment, the latching pin 6 presses the engage-target tip 4A in the mounting direction X of the unit and causes the engage-target tip 4A to retreat, in a same manner as the first exemplary embodiment. Accordingly, the same effect as in the first exemplary embodiment can be achieved in the present exemplary embodiment.

Variation Samples

In the above-described first through fourth exemplary embodiments, the drawing-in mechanism D is disposed on the printer main body 1A, and the engaging portion 5 is disposed on the sheet feeding cassette 9 which is a unit. However, the exemplary embodiments according to the present invention are not limited thereto, and the drawing-in mechanism D may be disposed on the unit. In other words, of the unit and the printer main body 1A, the drawing-in mechanism D may be disposed on the unit, on the other hand, the engaging portion 5 may be disposed on the printer main body 1A.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-262133 filed Nov. 30, 2011, which is hereby incorporated by reference herein in its entirety.

What is claimed is:

1. A drawing-in device configured to draw a unit mounted on and drawn out from an apparatus main body, to a predetermined position of the apparatus main body, the drawing-in device comprising:

an engaging portion disposed on one of the apparatus main body and the unit;

a drawing-in mechanism disposed on the other of the apparatus main body and the unit, including an engage-target portion that engages with the engaging portion, and an elastic member, and configured to draw the unit into the apparatus main body by displacing from a standby position to a drawing position under an elastic force of the elastic member; and an engage-target tip disposed on the engage-target portion and configured to perform locking at a locking position to prevent the engaging portion that engages with the engage-target portion at the drawing position of the drawing-in mechanism from disengaging from the engage-target portion;

wherein, in a case where the engaging portion does not engage with the engage-target portion at the drawing position of the drawing-in mechanism, the engage-target tip retreats from the locking position to a retreat position, being pressed in a mounting direction of the unit by the engaging portion so as to engage the engaging portion with the engage-target portion; and wherein the engage-target tip moves to the locking position when the engaging portion engages with the engage-target portion.

2. The drawing-in device according to claim 1, further comprising:

a spring member configured to bias the engage-target tip to the locking position;

wherein, in a case where the engaging portion does not engage with the engage-target portion at the drawing position of the drawing-in mechanism, the engage-target tip moves against a biasing force of the spring member to retreat from the locking position to the retreat position, being pressed in the mounting direction of the unit by the engaging portion so the engaging portion engages with the engage-target portion;

wherein the engage-target tip moves to the locking position due to the biasing force of the spring member when the engaging portion engages with the engage-target portion.

3. The drawing-in device according to claim 2, wherein the engage-target tip is disposed to rotate about a rotating shaft.

4. The drawing-in device according to claim 1, wherein the engage-target portion further includes a groove into which the engaging portion fits.

5. The drawing-in device according to claim 1, wherein the elastic member is configured to snap buckle; and wherein the engage-target portion is disposed on the elastic member configured to snap buckle.

6. An image forming apparatus comprising:

the drawing-in device according to claim 1; and an image forming unit configured to form an image on a sheet.

7. The image forming apparatus according to claim 6, further comprising:

a spring member configured to bias the engage-target tip toward the locking position;

wherein, in a case where the engaging portion does not engage with the engage-target portion at the drawing position of the drawing-in mechanism, the engage-target tip moves against a biasing force of the spring member to retreat from the locking position to the retreat position, being pressed in the mounting direction of the unit by the engaging portion so the engaging portion engages with the engage-target portion; and wherein the engage-target tip moves to the locking position due to the biasing force of the spring member when the engaging portion engages with the engage-target portion.

8. The image forming apparatus according to claim 6, wherein the engage-target tip is disposed to rotate about a rotating shaft.

9. The image forming apparatus according to claim 6, wherein the engage-target portion further includes a groove into which the engaging portion fits.

10. The image forming apparatus according to claim 6, wherein the elastic member is configured to snap buckle; and wherein the engage-target portion is disposed on the elastic member configured to snap buckle.

* * * * *